United States Patent [19]

Tanski

[11] Patent Number: 4,807,875

[45] Date of Patent: Feb. 28, 1989

[54] EXERCISE BENCH WITH SAFETY APPARATUS

[76] Inventor: John Tanski, 24 Janet Dr., New Britain, Conn. 06053

[21] Appl. No.: 66,321

[22] Filed: Jun. 25, 1987

[51] Int. Cl.[4] ..... A63B 13/00

[52] U.S. Cl. ..... 272/123; 272/144; 200/332; 200/573

[58] Field of Search ..... 272/117, 123, 129, 130, 272/134, DIG. 4; 200/153 L, 153 LA, 330, 331, 332

[56] References Cited

U.S. PATENT DOCUMENTS

| | | | |
|---|---|---|---|
| 2,365,120 | 12/1944 | Thirlwell | 200/153 L |
| 2,751,470 | 6/1956 | Bissonette | 200/153 LA X |
| 3,572,700 | 3/1971 | Mastropaolo | 272/130 X |
| 3,998,100 | 12/1976 | Pizaella et al. | 272/130 X |
| 4,249,726 | 2/1981 | Faust | 272/123 |
| 4,253,662 | 3/1981 | Podolak | 272/123 |
| 4,540,171 | 9/1985 | Clark et al. | 272/123 X |
| 4,615,524 | 10/1986 | Sutherland | 272/123 |
| 4,750,739 | 6/1988 | Lange | 272/123 X |

*Primary Examiner*—Richard J. Apley
*Assistant Examiner*—Robert W. Bahr
*Attorney, Agent, or Firm*—Robert S. Smith

[57] ABSTRACT

Exercise apparatus for use with an associated barbell includes a support for holding the body of a user in reclining position on his or her back, first and second generally vertically columns disposed on respective sides of the support and first and second bar raising arms carried respectively on the first and second arms. Each bar raising arm is mounted for vertical movement with respect to one of the columns; apparatus for raising and lowering the bar raising arm synchronism; and apparatus for sensing the lowering of the associated barbell to a predetermined position and actuating the apparatus for raising and lowering upon such event.

11 Claims, 1 Drawing Sheet

EXERCISE BENCH WITH SAFETY APPARATUS

BACKGROUND OF THE INVENTION

The invention relates generally to athletic and exercise equipment and more particularly to bench press apparatus which includes safety equipment to be used in conjunction with bench press exercising. When bench pressing, the person performing the exercise lies on his back on a bench with his feet on the floor and raises and lowers a barbell over his chest. The barbell consists of a bar having at its ends balanced, changeable weights which may have a combined weight in excess of 500 pounds. It is well known that it is extremely dangerous to perform a bench press exercise with heavy weights unless a spotter or other person is nearby in the event of the person performing the exercise has overextended himself and is unable to raise the barbell a final time to engage it with support members or pegs which are disposed above the chest of the user. When the person performing the exercise has assistance to enable him to lift the barbell, he can avoid any possibility that the barbell will settle or fall to his chest and injure him or her. It will be understood the area of contact will be along the relatively small extent of the bar and therefore the potential of injury to the person performing the exercise is extremely significant.

The prior art includes the following U.S. patents: U.S. Pat. Nos. 4,253,662 and 4,249,726. The apparatus described therein has not been wholly satisfactory.

An object of the present invention is to provide an apparatus for mechanically assisting a weight lifter should assistance be needed.

Another object of the invention is to provide apparatus which is relatively simple and thus will provide a highly reliable mechanism which can be manufactured inexpensively.

SUMMARY OF THE INVENTION

It has now been found that these and other objects of the invention may be attained in exercise apparatus for use with an associated barbell which includes a support for holding the body of a user in reclining position on his or her back, first and second generally vertically columns disposed on respective sides of the support, and first and second bar raising arms carried respectively on the first and second arms. Each bar raising arm is mounted for vertical movement with respect to one of the columns, and the apparatus includes means for raising and lowering the bar raising arms in synchronism, and means for sensing the lowering of the associated barbell to a predetermined position and actuating the means for raising and lowering upon such event.

In one form of the invention, the means for sensing comprises at least one pivot arm which is biased to a predetermined position and has switching means coupled thereto that is moved in response to movement of the arm. The means for raising and lowering the support arms may include a pair of generally horizontal arms and each of the generally horizontal arms may include a pair of spaced rollers. The means for raising and lower the associated barbell may further includes a roller chain and a reversible electric motor. The motor may be mechanically coupled to the chain by means of a bar which extends laterally intermediate the columns and at least one gear may couple the motor to the bar to provide relatively slow movement of the means for raising and lowering the associated barbell. A chain may be disposed in each column and may be coupled to the bar by means of sprockets fixed thereto.

The means for sensing may include an inclined ramp on the pivot arm and the switching means may include a switch having an actuating button cooperating with the inclined ramp for actuation thereof.

In one form of the invention, the columns are manufactured of sheet metal tubing and the generally horizontal arms each include a pair of spaced rollers on the generally horizontal arms dimensioned and configured for engagement with respective walls of the columns.

BRIEF DESCRIPTION OF THE DRAWING

The invention will be better understood by reference to the accompanying drawing in which.

DESCRIPTION OF THE PREFERRED EMBODIMENT

Figures 1, 2, 3:
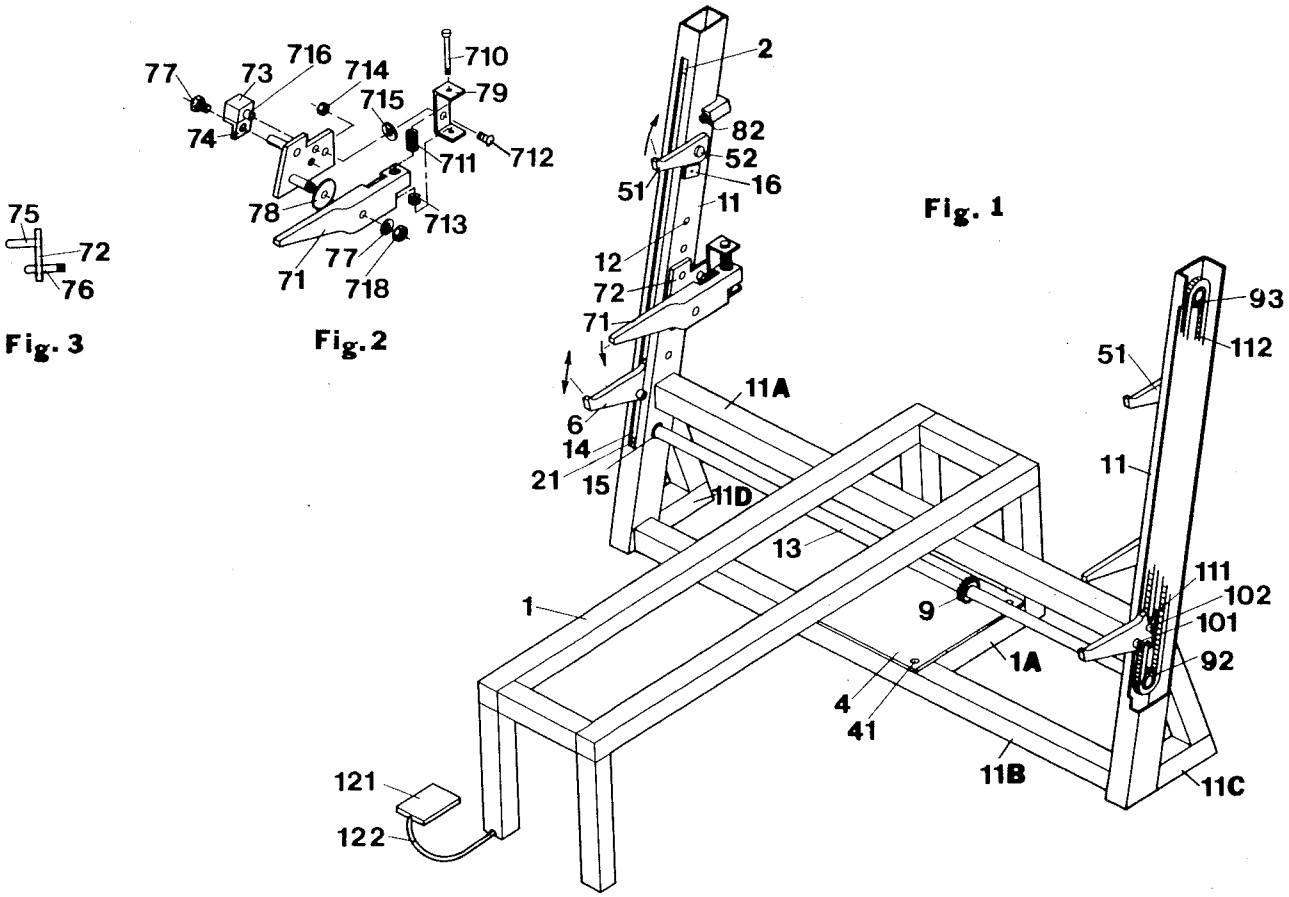
FIG. 1 is a perspective view of the apparatus in accordance with one form of the invention.
FIG. 2 is an exploded perspective view of a pivoting arm assembly which is a part of the apparatus shown in FIG. 1.
FIG. 3 is a side elevational view of one element of the pivoting arm assembly shown in FIG. 2.

Referring now to FIGS. 1–3 there is shown the apparatus in accordance with one form of the invention.

The apparatus includes a bench structure 1 which ordinarily will be manufactured of square 2 inch tubing which is $\frac{1}{4}$ inch thick. It will be understood to include a pad and support disposed on the framework illustrated in FIG. 1 even though these obvious structural features have been omitted in the drawing for clarity. Two spaced upstanding columns 11, 11 are disposed on each side of the bench structure. The columns 11, 11 are disposed at an angle of 10 degrees to a vertical line (not shown) and are mutually parallel. The columns are formed in the preferred embodiment from 3 inch by $4\frac{1}{2}$ inch tubing which is $\frac{1}{4}$ inch thick. The columns 11, 11 are coupled by laterally extending tubes or members 11A, 11B. The tube 11A is secured to the bench structure 1 and the colunns 11 are respectively supported by L-shaped members 11C, 11D fabricated of 2 inch square tubing. The laterally extending members 11A, 11B are vertically spaced. The lower most laterally extending member 11B is joined to the bench structure 1 at the floor level by horizontally extending tubing 1A which is a part of the bench structure 1. The bench structure 1 and specifically the part thereof provided for the user to lie on, in the conventional manner, bridges and laterally extending members 11A, 11B.

The colunns 11, 11 each support an upper pivoting arm 51, a lower pivoting arm 71 and a bar raising arm 6. These structures on the respective columns 11, 11 cooperate with the associated bar of a barbell assembly (not shown). More specifically, the upper pivoting arms 51, 51 provide a rest position for the barbell. The upper pivoting arms 51, 51 are movable between a generally horizontal position as shown in FIG. 1 and a generally vertical position in which the upper pivoting arms are pivoted clockwise. A respective stop 16 on each column 11 limits the downward movement of each upper pivoting arm 51 and the freedom of motion about a pivot 52 results in the pivoting arm assuming the generally horizontal position illustrated in FIG. 1 due to gravity unless it is raised and held upward manually such as by the action of a rising barbell.

A lower pivoting arms 71 and the associated structure are shown in greater detail in FIGS. 2 and 3. Each column 11 has a plurality of holes 12 disposed at uniform intervals. The holes extend laterally as best seen in the left (as viewed) column 11 of FIG. 1. These holes are dimensioned and configured to cooperate with the spaced generally parallel pins 75, 76 which are joined by a generally vertical plate 72. Each plate 72 also carries one of the lower pivoting arms 71. Each column 11 is manufactured of a rectangular cross section tubing as described above. The pin 75, as most apparent in FIG. 3, is long enough to fit through both of the opposed sides of the column 11. The pin 76 is long enough to reach through only the innermost side of the column 11 of which it cooperates. Accordingly, the user of the apparatus may select any of a plurality of vertical positions for any lower pivoting arm 71 merely by removing that lower pivoting arm 71 and associated structure and specifically the pins 75, 76 from the associated column 11 and reinserting the pins 75, 76 into the same column at a different elevation. Obviously, the user will adjust both lower pivoting arm assemblies at the same time and obviously they will be installed at the same elevation. This adjustment is necessary to provide for the physical size of the user. Ordinarily, the position will be selected so that upper surface of the lower pivoting arm 71, the surface which contacts the barbell, is disposed just above the chest of the user.

It will be understood that the generally parallel pins 75, 76 engage successive holes 12 in the side of a column 11 and more particularly that the structure visible on the left most colunn 11 in FIG. 1 has a counterpart on the inside face of the right most column 11 (as viewed). The pin 76 will, as best seen in FIG. 3, is longer on the right hand side of the plate 72 and is threaded at the free end. As best seen in FIG. 1, the longer end of pin 76 carries a washer 78 and the lower pivoting arm 71 together with another washer 717 and a nut 718. The lower pivoting arm 71 is biased to a stable generally horizontal position by two coil springs 711, 713. These springs 711, 713 bias the lower pivoting arm 71 to a stable position while allowing the lower pivoting arm 71 to rotate about the pin 76 either clockwise or counter clockwise. The actual movement which is possible of the lower pivoting arm 71 is limited by the lengths of the springs 711, 713 shown in FIG. 1. Disposed intermediate the top and the left side of the lower pivoting arm 71 is an inclined plane 71A. This inclined plane 71A is contoured like a chamfer and it cooperates with a switch 73 so that rotational movement of the lower pivoting arm 71 about the pin 76 causes depression of a plunger 716 which is a part of the switch 73. More particularly, counterclockwise movement of the lower pivoting arm 71 corresponding to a weight being applied to the upper surface thereof causes depression of the plunger 716. Clockwise movement of the lower pivoting arm 71 allows the plunger 716 to extend outwardly. It will be understood that the switch 73 opens and closes internal contacts (not shown) depending on the position of the plunger 716.

Each column 11 also carries a bar raising arm 6 which is moved upwardly and downwardly in mutual synchronism with the other bar raising arm 6 on the other column 11 by means of respective chains 112, 112. Each bar raising arm 6 extends through an elongated slot 11E in each column 11. The slot 11E extends along a substantial portion of a face of column 11. More particularly, the respective faces of each column 11 which have an elongated slot 11E in them are mutually coplanar. Each slot 11E has length sufficient to allow the associated bar raising arm 6 to move to an elevational position below the chest of the user while he is lying on the apparatus and extends vertically sufficiently to allow the bar raising arm 6 to move well above the chest of the user. The bar raising arm 6 is provided with two rollers 101, 102 which extend from both sides thereof. Each roller 101, 102 is mounted for free rotation and the rollers 101, 102 are spaced apart and dimensioned to engage opposite sides of the sheet metal of the tubing which forms the column 11. The rollers 101, 102 thus position the upper surface of the bar raising arms 6, 6 in a generally horizontal attitude so that they properly receive the associated barbell. The bar raising arm 6 are ordinarily welded to the respective chains 112 in the respective columns 11.

The chains 112 are mounted on respective sprockets 92, 93 in the respective columns 11. The sprockets 93 are mounted for free rotation on the spindle which is a part thereof. The sprockets 92 are fixed to the ends of a bar 13 which extends laterally across the entire length of the apparatus. The bar 13 is mounted for free rotation in the respective columns 11 by means of bearings 15 (one shown) in each column 11. A gear 91 fixed to the bar 13 is driven by a motor 4 having an integral speed reducing gear train. The motor 4 is either operated by a foot pedal 121 coupled by a cable 122 to the motor 4 or by automatic circuitry which is responsive to the switches 2, 73, 21 and 121. The switches 21 and 2 function in a manner similar to the switches controlling a garage door opener or automobile electric windshield wiper. The motor 4 will ordinarily be reversible.

The apparatus in accordance with the invention may be operated in either a manual or an automatic mode. The operation in the manual mode is as follows: the user lies on the bench 1 and picks the barbell off the upper pivoting arms 51, 51 and lowers the barbell to his chest. In this mode of operation, the lower pivoting arm 71 and the bar raising arm 6 are lower than the chest of the user. This position is achieved with the lower pivoting arms 71 by engaging the pins 75, 76 in a pair of adjacent holes 12 inside of a column 11 that are sufficiently low so that the lower pivoting arm 71 does not intefere. The user may either raise the barbell manually (the conventional way) or use the motor and bar raising arm 6 to raise the barbell up to the upper pivoting arm 51 if he feels unable to raise the barbell. In the latter case, he may push on the foot pedal 121 with his foot and this will energize the motor 4 which will drive the gear 91 and thence the sprockets 92, 92 and chains 112, 112 will raise the bar raising arms 6, 6 and thus raise the barbell. The bar raising arms 6 are in different vertical planes than are the upper and lower pivoting arms 51, 71 and thus there is not interference. The upward moving barbell will push the upper pivoting arms 51 upwardly and then the upward pivoting arms 51 will fall back down due to gravity and spring 81 so that they will receive the barbell as the arms 6 are lowered.

The second mode of operation is the automatic mode which ordinarily will be used when the user is performing a single repetition. In this mode, the user position the lower pivoting arms 71, 71 approximately 2 inches above the user'chest. The bar raising arms 6 are positioned below the user's chest. The user will pick the barbell off the upper pivoting arms 51 and lower it to his chest and thereby actuate the switch 713 which is associated with the lower pivoting arm 71.

The switch 73 will automatically actuate the motor 4 which will slowly drive the gear 91, sprockets 92, 92 chains 112, 112 and thus the bar raising arms 6, 6 to a higher elevation and engage the barbell to raise it out of the user's way. Particularly, in this mode the movement of the bar raising arm 6 will be relatively slow so that the user can manually raise the barbell if he chooses to do so and is able to do so. If after a brief interval he is unable do so or does not wish to raise the barbell, the bar raising arms 6, 6 will move upwardly a sufficient distance to engage the barbell and raise it away from the chest of the user and thus relieve him of the burden of the raising the barbell. It will be understood that the bar raising arms 6, 6 are disposed in a different vertical plane then the plane in which the upper and lower pivoting arms 51, 71 are located. Thus, the bar raising arms 6, 6 can move up and down without interference. Typically, the bar raising arm 6 will raise the upper pivot arms as the barbell rises up to and then above the upper pivoting arms 51 and then the upper pivoting arms 51 will fall down and receive the then descending barbell.

It will thus be seen that the apparatus provides for accomplishing the various objects of the invention including providing needed assistance to a weight lifter and also being relatively simple.

Those skilled in the art of exercice apparatus will recognize that this modifications may be made in this apparatus without departing from the spirit of the invention. It is accordingly intended that the invention be limited only by the scope of the appended claims.

Having thus described my invention I claim:

1. Exercise apparatus for use with an associated barbell which comprises:

a support for holding the body of a user in reclining position on his or her back;

first and second generally vertical columns disposed on respective sides of said support;

first and second bar raising arms carried respectively on said first and second generally vertical columns, each bar raising arm being mounted for vertical movement with respect to one of said columns;

means for raising said bar raising arms in synchronism; and means integral with said exercise apparatus for sensing the lowering of the associated barbell to a predetermined vertical elevation and switching means integral with said exercise apparatus for automatically moving at least one switch contact upon sensing the lowering of the associated barbell to said predetermined vertical elevation and means for actuating said means for raising upon movement of said one switch contact.

2. The apparatus as described in claim 1 wherein:

said means for sensing comprises at least one pivot arm which is biased to a predetermined position and has switching means coupled thereto that moves from a first position to a second position upon movement of said pivot arm.

3. The apparatus as described in claim 2 wherein:

each of said columns includese a web shaped surface; and said means for raising and lowering said support arms comprises a pair of generally horizontal arms and each of said generally horizontal arms includes at least a pair of spaced rollers engaging a said web shaped surface on said first and second columns.

4. The apparatus as described in claim 3 wherein:

said means for raising and lowering the associated barbell further includes a roller chain.

5. The apparatus as described in claim 4 wherein:

said means for raising and lowering the associated barbell further includes a reversible electric motor.

6. The apparatus as described in claim 5 wherein:

said motor is mechanically coupled to said chain by means of a bar which extends laterally intermediate said columns.

7. The apparatus as described in claim 6 wherein:

said means for raising and lowering the associated barbell further includes at least one gear coupling said motor to said bar to provide relatively slow movement of said means for raising and lowering the associated barbell.

8. The apparatus as described in claim 7 wherein:

said means for raising and lowering the associated barbell further includes a chain disposed in each column and coupled to said bar by means of sprockets fixed thereto.

9. The apparatus as described in claim 8 wherein:

said means for sensing includes an inclined ramp on said pivot arm.

10. The apparatus as described in claim 9 wherein:

said switching means includes a switch having an actuating button cooperating with said inclined ramp for actuation thereof.

11. The apparatus as described in claim 10 wherein:

said columns are manufactured of sheet metal tubing and said generally horizontal arms each include at least a pair of spaced rollers on said generally horizontal arms dimensioned and configured for engagement with respective walls of said columns.

* * * * *